US005921465A

United States Patent [19]

Garton

[11] Patent Number: 5,921,465

[45] Date of Patent: Jul. 13, 1999

[54] INSTANT SET-UP BULK BOX

[75] Inventor: Harold W. Garton, Sugar Hill, Ga.

[73] Assignee: Georgia Pacific Corporation, Atlanta, Ga.

[21] Appl. No.: 08/971,046

[22] Filed: Nov. 14, 1997

[51] Int. Cl.[6] ..... B65D 5/00

[52] U.S. Cl. ..... 229/109; 229/117.06; 229/108.1; 229/122.3; 206/600

[58] Field of Search ..... 229/109, 117.01, 229/117.02, 117.05, 108.01, 122.28, 122.29, 122.3, 125.011; 206/600, 386

[56] References Cited

U.S. PATENT DOCUMENTS

| | | | |
|---|---|---|---|
| 1,063,845 | 6/1913 | Weiss | 229/122.3 |
| 1,555,054 | 9/1925 | Berkowitz | 229/117.01 X |
| 1,720,146 | 7/1929 | Reese . | |
| 2,091,291 | 9/1937 | Ringer . | |
| 2,151,761 | 3/1939 | Hartman | 229/108.1 |
| 2,332,256 | 10/1943 | Polay | 229/117.01 X |
| 2,749,018 | 5/1956 | Berke | 229/109 X |
| 2,826,350 | 3/1958 | Marx . | |
| 2,858,968 | 11/1958 | Pellaton . | |
| 2,934,254 | 4/1960 | Ullger . | |
| 3,069,062 | 12/1962 | Keith . | |
| 3,083,889 | 4/1963 | Christensson . | |
| 3,101,167 | 8/1963 | Styler . | |
| 3,109,574 | 11/1963 | Lange . | |
| 3,115,291 | 12/1963 | Kotowick . | |
| 3,132,791 | 5/1964 | Haysler et al. . | |
| 3,344,971 | 10/1967 | Walker . | |
| 3,373,917 | 3/1968 | Cox . | |
| 3,474,951 | 10/1969 | Egleston et al. . | |
| 3,494,536 | 2/1970 | Henry | 229/117 |
| 3,525,466 | 8/1970 | Robinson . | |
| 3,561,667 | 2/1971 | Saltman . | |
| 3,565,235 | 2/1971 | Brown . | |
| 3,642,192 | 2/1972 | Wilcox, Jr. et al. . | |
| 3,809,310 | 5/1974 | VanderLugt, Jr. . | |
| 3,877,631 | 4/1975 | Lai et al. . | |
| 3,907,194 | 9/1975 | Davenport et al. . | |
| 4,065,047 | 12/1977 | Swan . | |
| 4,109,985 | 8/1978 | Lieb, Jr. . | |
| 4,146,169 | 3/1979 | Meyers et al. . | |
| 4,166,567 | 9/1979 | Beach, Jr. et al. . | |
| 4,185,764 | 1/1980 | Cote . | |
| 4,199,098 | 4/1980 | Lopez . | |
| 4,243,171 | 1/1981 | Prin . | |
| 4,244,510 | 1/1981 | Synder et al. . | |
| 4,260,100 | 4/1981 | Hoffman . | |
| 4,289,267 | 9/1981 | Mayea . | |
| 4,291,828 | 9/1981 | Nigro | 229/117 |
| 4,343,429 | 8/1982 | Cherry . | |
| 4,448,309 | 5/1984 | Roccaforte et al. . | |
| 4,453,665 | 6/1984 | Roccaforte et al. . | |
| 4,470,540 | 9/1984 | Koltz . | |

(List continued on next page.)

OTHER PUBLICATIONS

Georgia–Pacific Technology and Development Center drawings (2) dated Jul. 28, 1997, showing blanks for Inland bulk box described in Background of the Invention.

*Primary Examiner*—Gary E. Elkins
*Assistant Examiner*—Tri M. Mai
*Attorney, Agent, or Firm*—Banner & Witcoff, Ltd.

[57] ABSTRACT

An octagonal bulk box well suited for use in pallet storage and transportation of large quantities of flowable solids has a construction allowing the box to be instantly manually erected by the end user. A box precursor which is erectable from a substantially flat condition to form the box is formed of a main blank providing the sidewall panels of the box and a floor blank from which the entire box floor structure is constructed. By forming the entire floor from a floor blank separate from the main blank, it is possible to reduce material expense and waste, since the entire floor blank can be constructed of fiberboard lower in strength and cost than that required for the sidewalls. The floor blank is attached to the main blank by connecting flaps extending about substantially the entire lower perimeter of the box walls, on an outside thereof. This configuration serves to reinforce the lower perimeter of the box sidewalls against the large outward bulge forces generated by flowable loads, particularly in the lower third of the box.

12 Claims, 8 Drawing Sheets

U.S. PATENT DOCUMENTS 4,502,624 3/1985 Burrell .
4,540,116 9/1985 Shirakawa .
4,549,690 10/1985 Rosenburg .
4,607,785 8/1986 Croley .
4,676,429 6/1987 Crowe et al. .
4,702,408 10/1987 Powlenko .
4,717,022 1/1988 Combs .
4,742,915 5/1988 Ringer .
4,747,485 5/1988 Chaussadas .
4,760,922 8/1988 Northgrave .
4,795,082 1/1989 Fujihara et al. .
4,834,255 5/1989 Boots .
4,854,474 8/1989 Murray et al. .
4,856,705 8/1989 Carr et al. .
4,871,068 10/1989 Dreyfus .
4,881,683 11/1989 Linnemann .
4,917,289 4/1990 Linnemann et al. .
5,040,721 8/1991 Essack .
5,115,965 5/1992 Alepuz .
5,295,623 3/1994 Bacques et al. .
5,351,879 10/1994 Lui et al. .
5,485,951 1/1996 Phillips .
5,531,374 7/1996 Gasper .
5,531,375 7/1996 Palm .
5,533,666 7/1996 Cromwell .
5,542,541 8/1996 Smith .
5,558,272 9/1996 Magister .
5,613,694 3/1997 Gasper .
5,628,450 5/1997 Cromwell et al. .
5,630,543 5/1997 Dugan .
5,715,991 2/1998 Gasper .

INSTANT SET-UP BULK BOX

BACKGROUND OF THE INVENTION

The present invention relates to containers formed from blanks of sheet material, e.g., corrugated fiberboard. More specifically, the invention concerns bulk boxes instantly manually erectable by the end user from a flat stackable box precursor, and blanks therefor. One use of such containers is for shipping and storing on pallets bulk quantities of dry flowable material (e.g., 1000–2000 lb. quantities of plastic beads or pellets used for injection molding).

Bulk boxes of the aforementioned variety are known. An exemplary construction is disclosed in U.S. Pat. Nos. 5,531,374 and 5,613,694 to Gasper. The Gasper boxes are erectable into an octagonal shape from a flat box precursor comprising opposed wall and floor forming panels. Manual pressure exerted inwardly on opposite folded vertical edges of the box precursor causes the opposing wall panels to separate from each other and form an octagonal shape tubular structure. At the same time, floor forming flaps previously lying flat against each other rotate, unfold and fold-over to form a box floor structure. A "band" structure is unfolded along a longitudinal fold line thereof to form, with a connecting member, a central floor region. Outer and central flaps provide floor surfaces flanking the band at the opposite box ends. Specifically, outer flap pairs at the opposite box ends are rotated and folded over to partially overlap the band on its bottom side. Central bottom flaps are positioned between the outer flaps at each end and are hingedly connected to the outer flaps by connecting web panels. Initially folded upon themselves, these flaps open up then fold over to partially overlap the band on its top side (inside the box).

In a variation of the design described in the Gasper patents, Creative Tech Marketing (assignee of the Gasper patents) has offered for sale a box wherein the outer bottom flaps are hingedly attached to the band and the central bottom flaps arm free from attachment to the outer bottom flaps. The outer bottom flaps rotate into a position underlying the band upon separation of the wall panels. It is then necessary to fold-over the central bottom flaps to a position underlying the outer bottom flap pairs.

In the typical bulk box application, the box floor serves merely to provide a protective layer between the box contents, e.g., dry flowable material, and a pallet support surface. Since the box floor obtains its structure strength from an underlying pallet, and the box is not intended to be lifted, when loaded, independently of a pallet, it is unnecessary for the floor structure to have substantial structural strength. On the other hand, the sidewalls of the bulk box must have considerable strength to resist the large outward bulge bulge forces generated by a flawable load, particularly in a lower part of the box, and to provide a stacking strength enabling multiple loaded containers (and underlying pallets) to be stacked upon each other. Regarding the latter, the sidewalls of bull boxes of the type described typically are configured to be able to withstand 10,000–18,000 lbs. in top-to-bottom compression.

In the Gasper designs, all the floor structure except a relatively small connecting member attaching separate panels of the band are formed integrally as an extension of the blank material to form the sidewall panels. Thus, the floor layer is composed largely of the same relatively high strength and high cost corrugation as is used for the sidewalls, when a much lower strength and lower cost grade of corrugation would serve just as well.

Another octagonal bulk box designed for quick set-up by the end user has been offered by Inland Paperboard and Packing Inc. of Indianapolis, Ind., as the "Quickset II." This construction is largely like the second Gasper design mentioned above, but with the corresponding band and connected outer bottom flaps being integrally formed as part of a floor blank separate from the main blank used to form the container sidewalls. The floor blank includes glue tabs for attachment of that blank about the inside lower edge of the main blank. As a separate piece, the floor blank can be made from a lighter grade of corrugation. However, the design still requires that the central bottom flaps be formed as integral extensions of the main blank used to form the wall panels, so that these flaps are constructed of higher strength and higher cost material than is necessary. Moreover, production of the two protruding central flaps requires die cutting of the blank from a rectangular piece of corrugation material having an overall extra width to provide for material to form the central flaps. This results in a high cost of material and to manufacture, and a substantial amount of unusable heavy scrap material for each blank which is produced.

SUMMARY OF THE INVENTION

In view of the foregoing, it is a principal object of the present invention to provide an instant se-up bulk box construction which allows significant cost and materials savings over previous designs.

It is a further object of the invention to provide an instant set-up bulk box construction with improved strength, particularly against the large bulge forces generated by flowable loads along the lower perimeter of the box sidewalls.

These and other objects are achieved in accordance with the present invention by A collapsible box assembly adapted to be manually convertible from a substantially flat box precursor to an erected box. The box assembly comprises a wall structure including a plurality of wall panels of sheet material pivotally connected along adjacent longitudinal edges to form a closed loop. The wall panels comprise pairs of wall panels laid-up against each other in the box precursor and separable from each other to form a polygonal tubular structure in the erected box, by exertion of opposing forces on opposing ones of said longitudinal edges. A floor structure is attached to the wall structure. The floor structure comprises a plurality of floor panels of sheet material. The floor panels comprise pairs of floor panels which can be laid-up against each other, in generally coplanar relation to the wall panels, in the box precursor. The pairs of floor panels being configured such that separation of the wall panel pairs to form the polygonal tubular structure causes a separation of the floor panel pairs and movement of the floor panels at least partially into a box floor forming condition. The floor panels, when placed fully in said box forming condition, partially overlap with each other to substantially completely cover an end of the polygonal tubular structure. The wall structure is formed from a first blank of sheet material forming no part of the floor structure. The floor structure comprises a second blank of sheet material distinct from the first blank.

Preferably, the first blank of sheet material comprises corrugated fiberboard of a first weight, and the second blank comprises corrugated fiberboard of a second weight lesser than said first weight. It is further preferred that the floor structure be formed entirely from the second blank of sheet material, and that the floor structure comprise a plurality of tabs attaching the floor structure to the wall structure about substantially the entire perimeter of the closed loop.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

The two-piece construction of the present inventive box assembly is clearly seen in FIGS. 1–4. The assembly includes a wall structure and a floor structure. The wall structure includes a plurality of wall panels of sheet material (e.g., corrugated fiberboard, corrugated plastic, and cardboard) pivotally connected along adjacent longitudinal edges to form a closed loop. Specifically, in the preferred embodiment for forming an octagonal-shaped box, the wall structure includes wall panels arranged such that in an erected state, symmetry exists across a longitudinal axis of the box. For convenience and ease of understanding, panels located to one side of the line of symmetry will include the letter "A" in their reference number. Panels on the other side of the line of symmetry will be denoted by inclusion of the letter "B" in their reference numbers.

Figure 1:
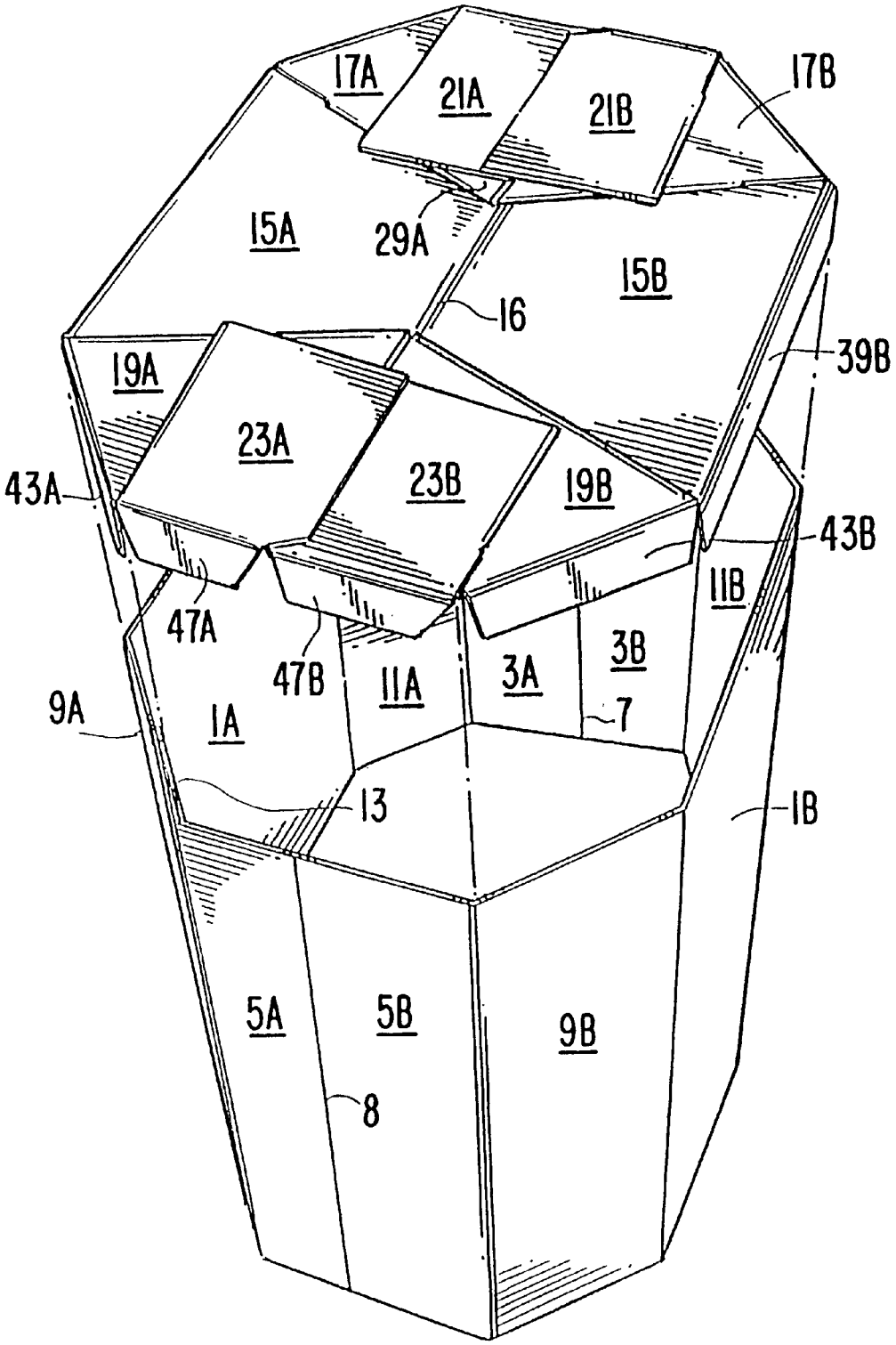
FIG. 1 is an exploded perspective view showing (floor side up in its erected state) a two-piece construction of an octagonal instant set-up bulk box in accordance with the present invention.
Figure 2:
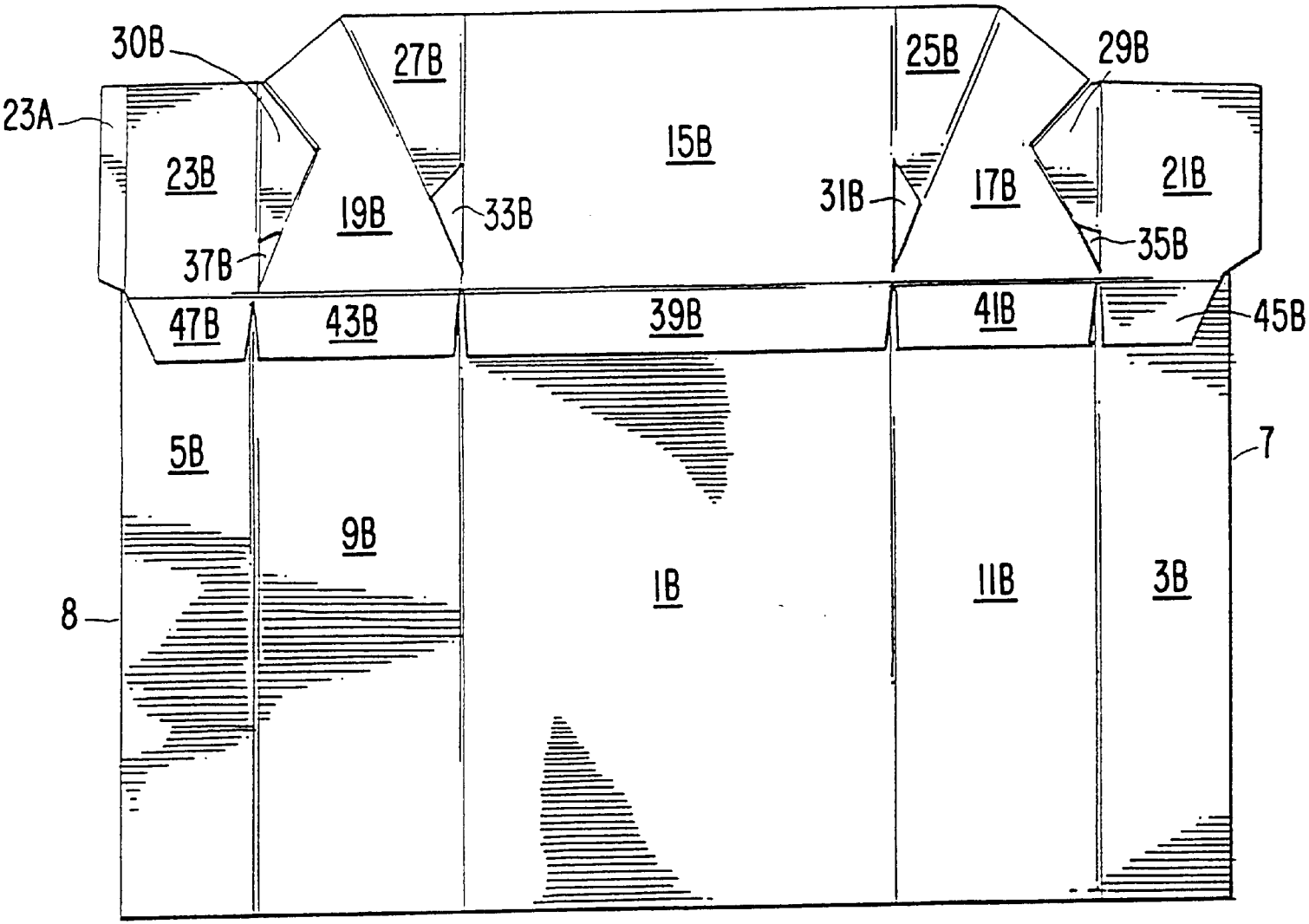
FIG. 2 is a plan view showing a precursor assembly of the box of FIG. 1, folded flat with opposing floor and wall panels laid-up against each other.
Figure 3:
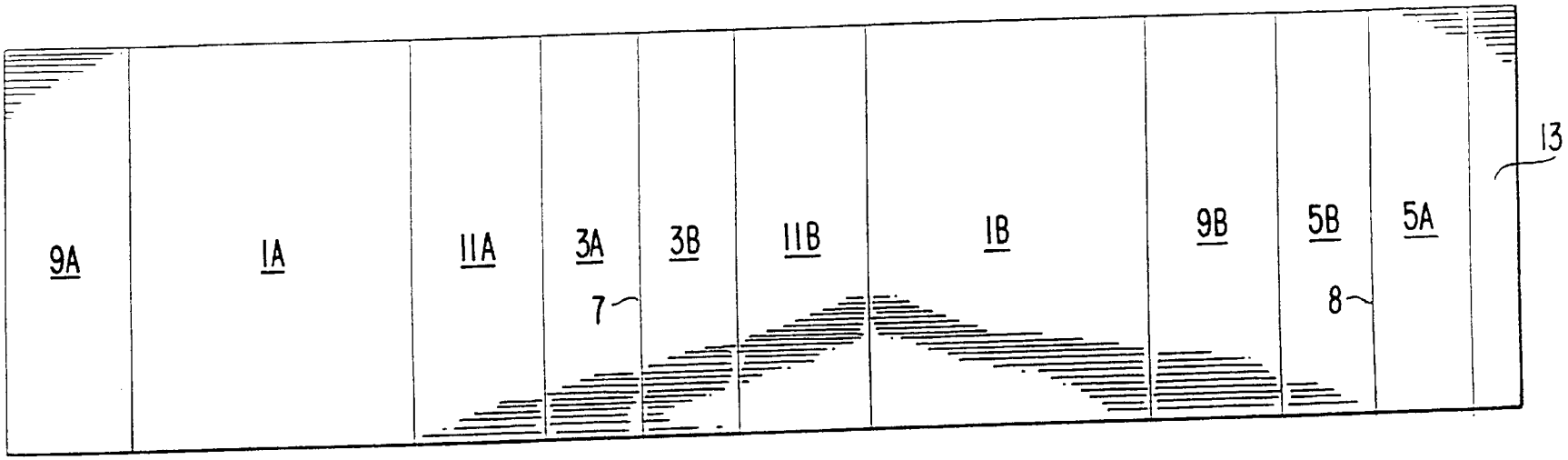
FIG. 3 is a plan view of a main blank for forming opposing sidewalls of the box of FIG. 1.
Figure 4:
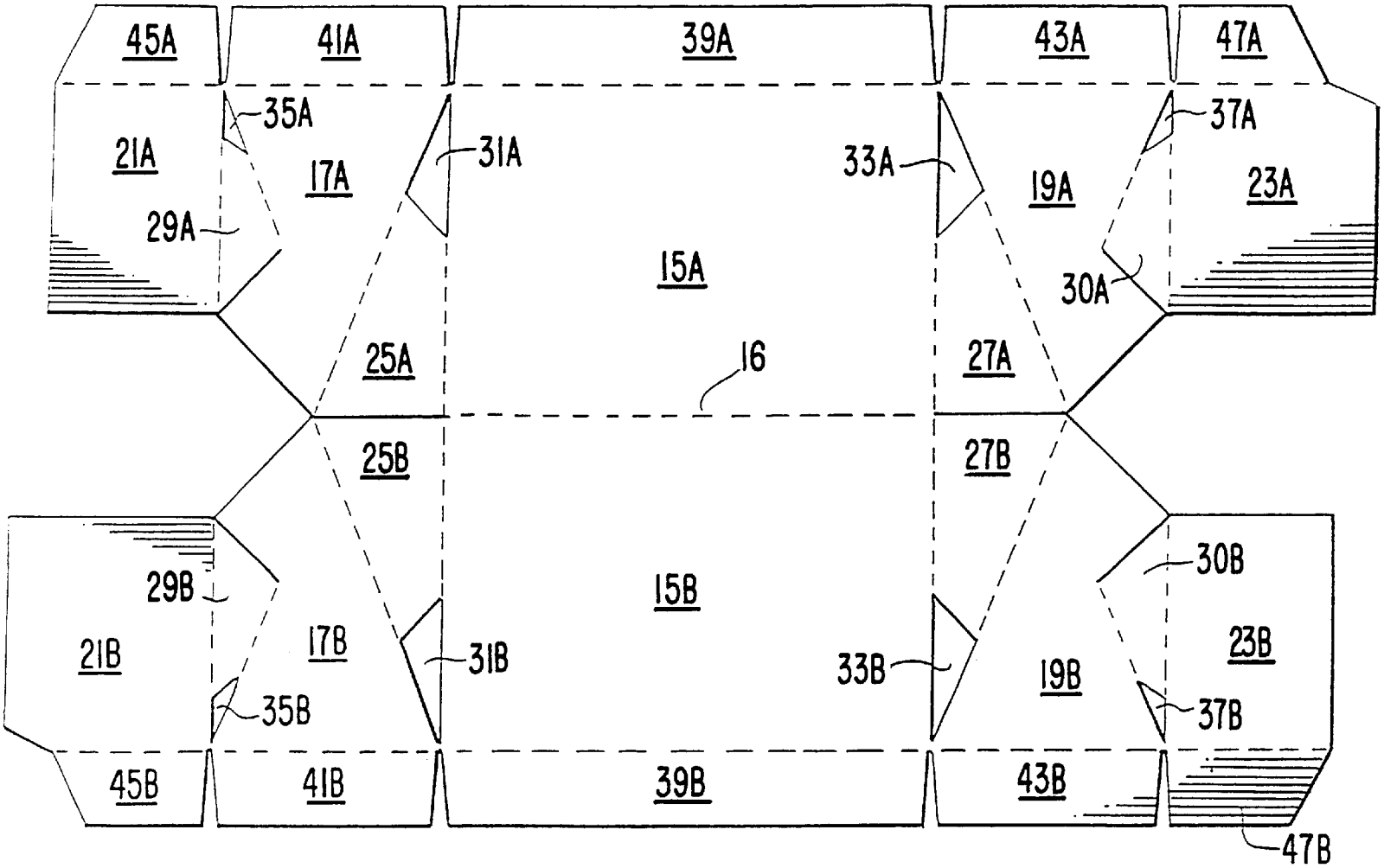
FIG. 4 is a plan view of a floor blank for forming the entire floor structure of the box of FIG. 1.

The wall structure of the exemplary embodiment includes first and second side wall panels 1A, 1B, and end wall panels 3A, 3B, 5A, 5B. The respective end wall panel pairs are connected along respective supplemental fold lines 7, 8. In addition, the wall structure includes a first pair of diagonal wall panels 9A, 9B and a second pair of diagonal wall panels 11A, 11B. To form a closed loop, a wall tab 13 extends along end wall panel 5A for securement (e.g., by gluing, stapling, or taping) on the inside (or outside) of diagonal wall panel 9A. From a manufacturing standpoint, it may be preferable to locate tab 13 along diagonal wall panel 9A, whereby the wall tab would be attached to wall panel 5A to form a closed loop. As best seen in FIG. 2, the pairs of wall panels of the wall structure are laid-up against each other when the assembly assumes a substantially flat box precursor condition. The wall panel pairs are separable from each other to form the polygonal tubular structure of the erected box seen in FIG. 1, by exertion of opposing forces on the edges formed by intermediate fold lines 7, 8.

The floor structure of the collapsible box assembly is formed from a blank entirely separate from the blank used to form the wall structure. Thus, it can, and preferably is, formed from sheet material (e.g., corrugated fiberboard) of a weight lesser than that used in the blank for the wall structure. As pointed out in the Background section, since the box floor will obtain its structural strength from an underlying pallet, shipping platform or the like, and the box is not intended to be lifted, when loaded, independently of a pallet, it is unnecessary for the floor structure to have substantial structural strength. On the other hand, the side walls of the bulk box must have considerable strength to (1) resist the large outward bulge generated by a flowable load, particularly in a lower third part of the box, and (2) provide a stacking strength enabling multiple loaded containers (and uderlying palets) to be stacked upon each other. Except as otherwise indicated, the term "blank" as used hereon broadly encompasses single piece blank as well as composite blank structures comprising a plurality of separately formed blanks subsequently secured (eg., laminated) to one another to form a multilayer or multi-piece unit.

The floor comprises a plurality of floor panels of sheet material. A pair of main floor panels 15A, 15B are hinged to each other about a longitudinal fold line 16. Main floor panels 15A, 15B are flanked by respective pairs of inner and outer flanking floor panels. Main floor panel 15A is flanked by a pair of inner flanking floor panels 17A, 19A. Main floor panel 15B is flanked by a pair of inner flanking floor panels. Inner flaking floor panels 17A, 19A are hingedly connected to main floor panel 15A through respective first connecting web panels 25A, 27A. Likewise, inner flanking floor panels 17B, 19B are hingedly connected to main floor panel 15B through respective first connecting web panels 25B, 27B. Each inner flanking floor panel 17A, 19A, 17B, 19B is hingedly connected to a respective outer flanking floor panel 21A, 23A, 21B, 23B through respective second connecting web panels 29A, 30A, 29B, 30B which are smaller than the first connecting web panels. First relatively large fold-facilitating triangular cut-outs 31A, 33A, 31B, 33B are formed between respective pairs of the main floor panels 15A, 15B and the inner flanking floor panels 17A, 19A, 17B, 19B, adjacent to relatively large first connecting web panels 25A, 27A, 25B, 27B. Second smaller fold-facilitating cut-outs 35A, 37A, 35B, 37B are formed between respective pairs of inner flanking floor panels 17A, 19A, 17B, 19B and outer flanking floor panels 21A, 23A, 21B, 23B, adjacent the second (smaller) connecting web panels 29A, 30A, 29B, 30B.

Figure 5:
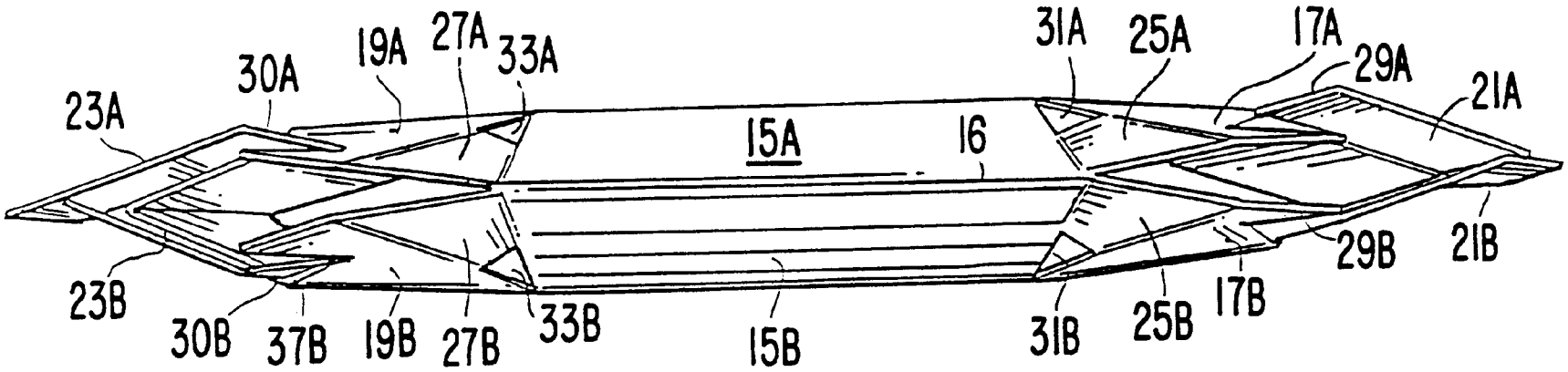
FIG. 5 is a bottom plan view of the box precursor of FIG. 2, in the initial stages of being unfolded.
Figure 6:
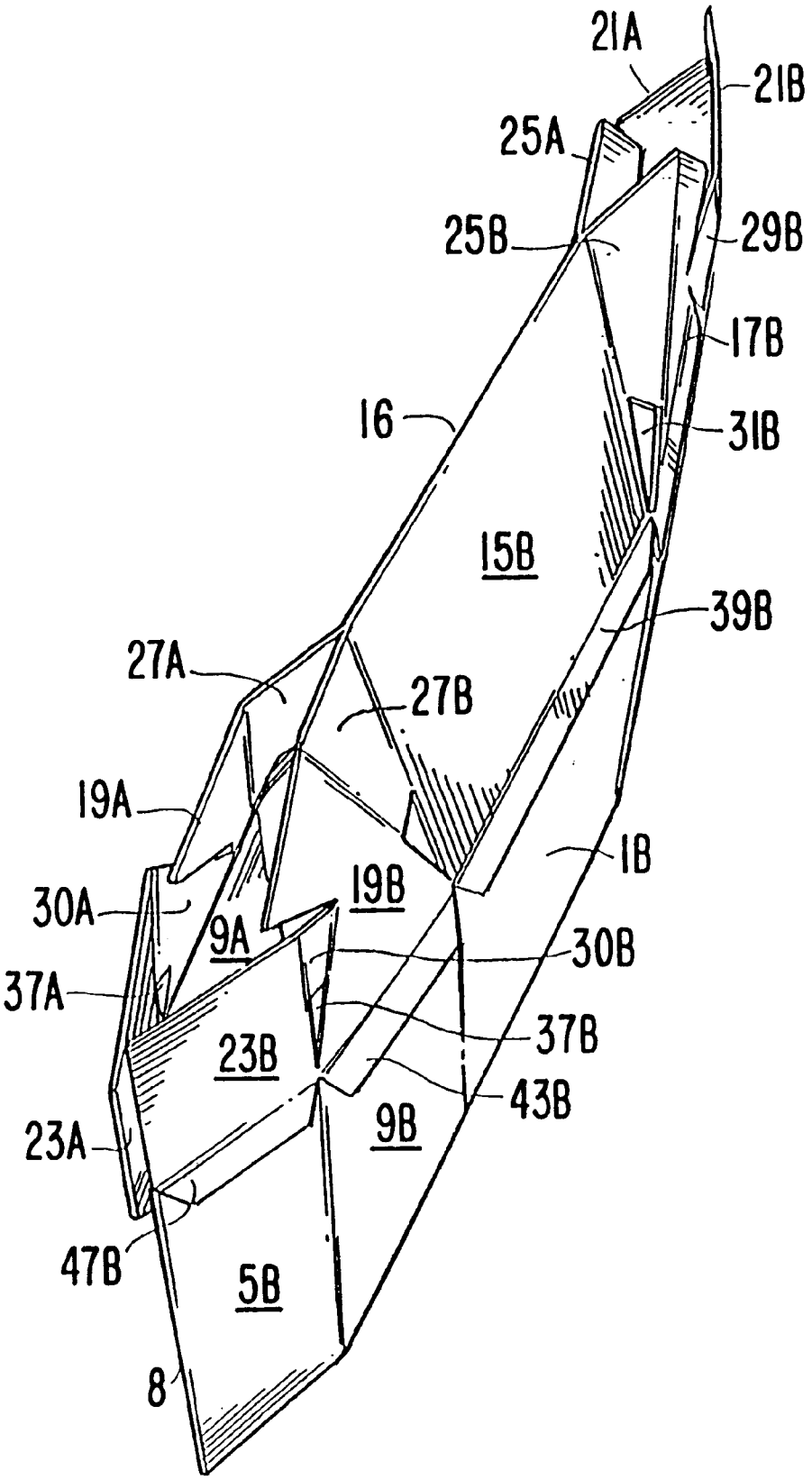
FIG. 6 is a bottom side perspective view of the box precursor of FIG. 2, in the slightly unfolded condition shown in FIG. 5.
Figure 7:
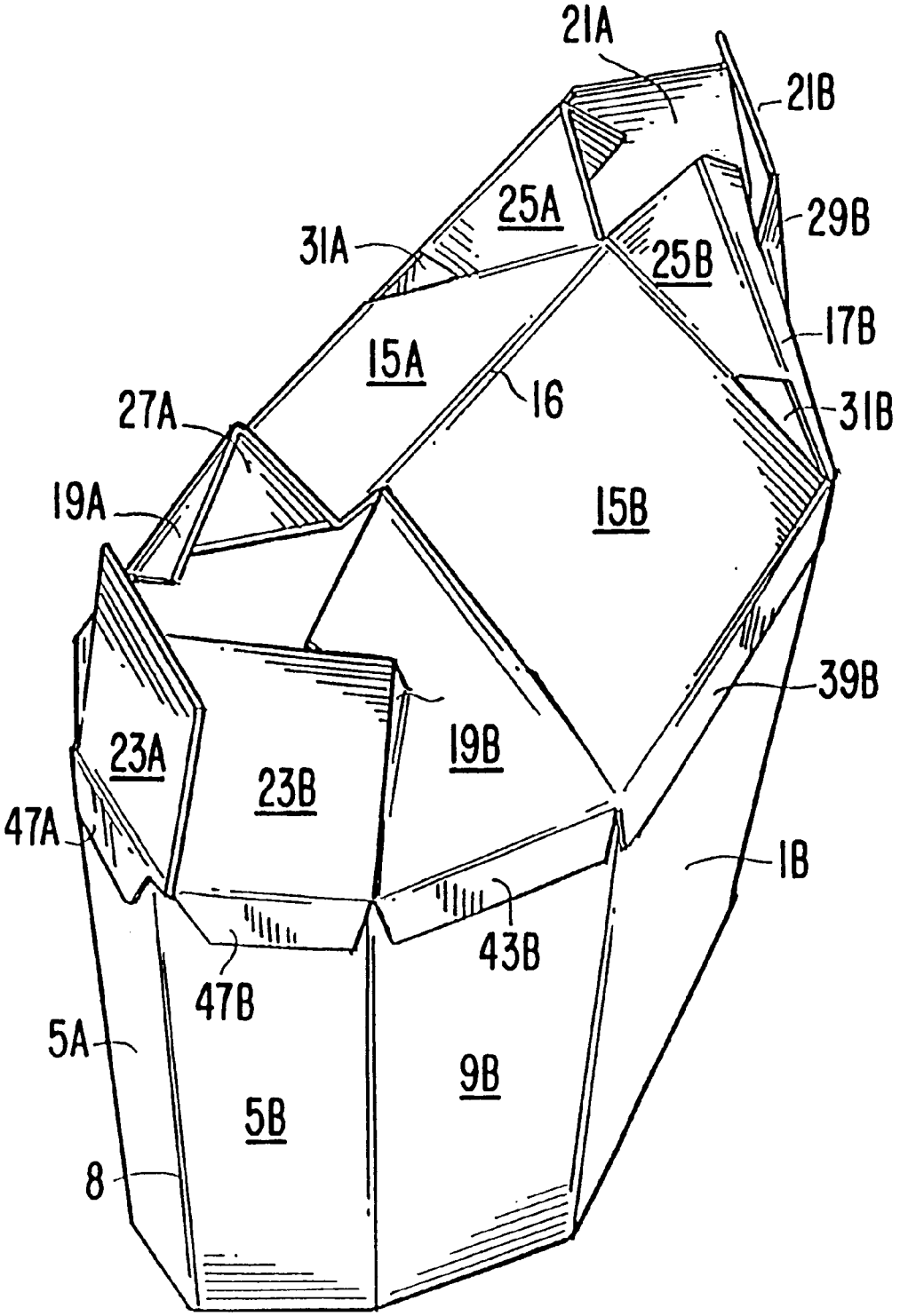
FIG. 7 is a bottom side perspective view like that shown in FIG. 6, showing the box precursor in a more advanced partially erected state.
Figure 8:
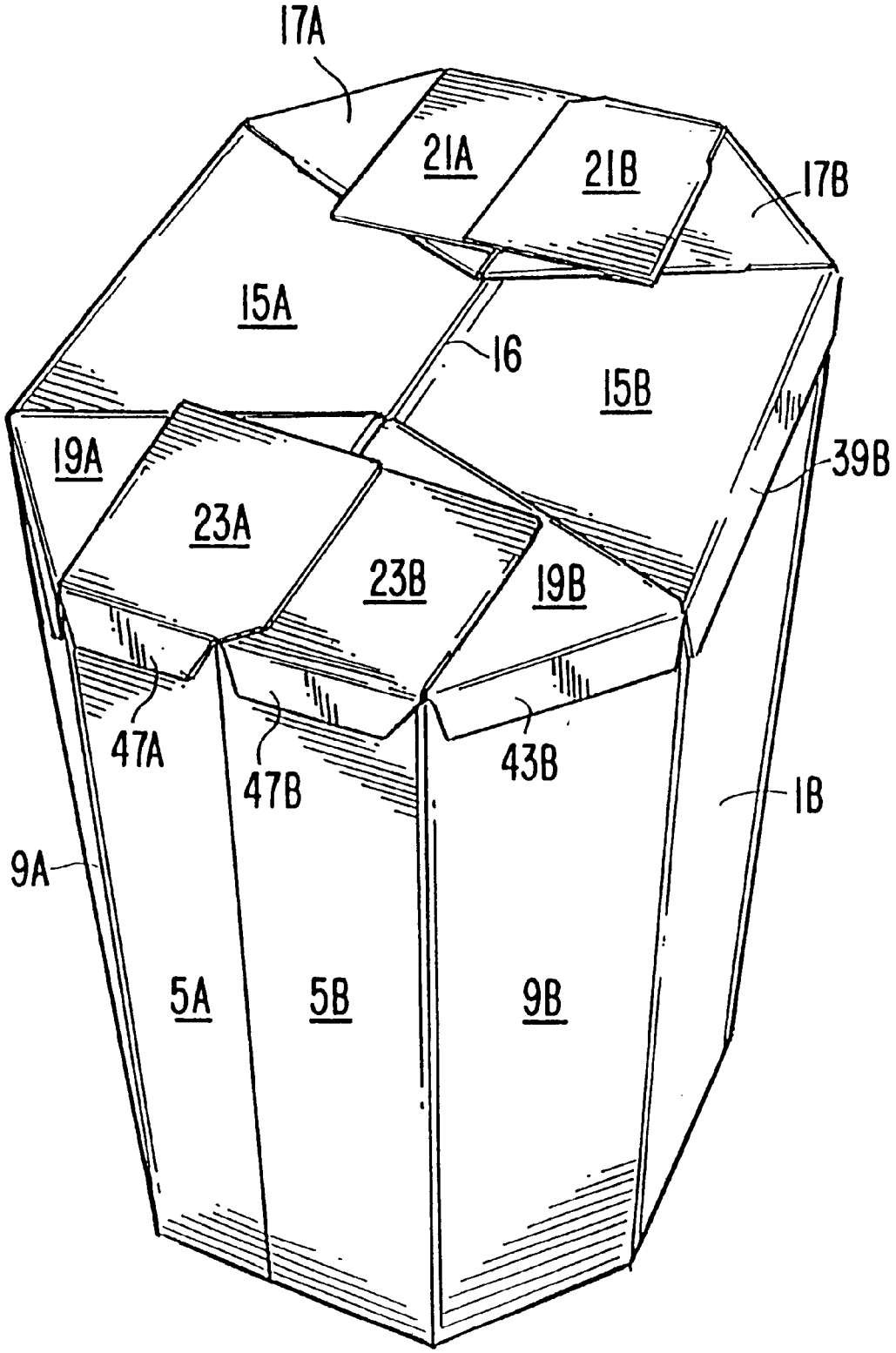
FIG. 8 is a bottom side perspective view showing the fully erected box resulting from the unfolding operation of FIGS. 5–7.

As best seen in FIG. 2, pairs of the floor panels are laid-up against each other, in generally coplanar relation to the wall panels of the wall structure, when the box assembly is in the box precursor condition. The pairs of floor panels are configured such that separation of the wall panel pairs to form an octagonal tubular shape causes a separation of the floor panels and movement of the floor panels at least partially into a box floor forming condition. This movement (i.e., unfolding, rotation and folding-over) is sequentially illustrated in FIGS. 5–7. The condition shown in FIG. 7, with the floor panels placed partially into a box floor forming condition can be achieved simply by manual pressure exerted inwardly against supplemental fold lines 7, 8. The box can be moved into a fully erected box forming condition, by pressing downwardly on fold line 16 with the box in the inverted position shown in FIG. 7, or by flipping the box over to an upright use orientation and placing it on a supporting pallet or floor surface, whereby the weight of the collapsible box assembly provides a pressing force against the supporting surface serving to complete formation of the floor. As seen in FIG. 8, in this completed state, the floor panels partially overlap with each other to substantially cover the end of the octagonal tubular structure. To avoid formation of a space between the respective pairs of flanking floor panels 21A, 21B, 23A, 23B, one panel of each pair (21B, 23A) is slightly increased in width so as to overlap with the respective other panel (21A, 23B).

The floor structure is preferably secured to the wall structure by a plurality of connecting flaps extending about substantially the entire perimeter of the closed loop formed by the wall structure. In particular, the connecting flaps include, as most clearly seen in FIG. 4, side wall connecting flaps 39A, 39B, diagonal wall connecting flaps 41A, 41B, 43A, 43B, and end wall connecting flaps 45A, 45B, 47A, 47B. Thus, each wall panel has associated therewith a connecting flap of the floor structure which is glued or otherwise secured thereto. The extra material layer provided by the connecting flaps attached about the lower perimeter of the wall panels affords greater strength to resist the substantial outward bulge forces caused by large masses of flowable solids. In contrast, in the Inland Paperboard and Packaging, Inc. design described in the Background section, the connecting flaps of the floor piece do not extend across the end wall panels, thus leaving the end walls more susceptible to bulging (elephant footing).

It is further preferred that the connecting flaps of the floor structure be secured on the outsides of the wall panels, as opposed to the insides as in the Inland design. This renders the bulk box of the invention less susceptible to delamination within the wall panel material, and detachment or separation of the floor structure, due to peeling of the flaps away from the wall panels under the bulge forces generated by a large flowable load. By attaching the flaps on the outer sides of the wall panels, the forces tending to separate the connecting flaps from the wall are aligned in a shear direction parallel to the wall panels. In contrast, in the Inland Paperboard and Packaging, Inc. design, wherein the floor blank is attached to the inside of the sidewall blank, bulge forces are translated into peel forces that can result in sidewall blank separation/delamination causing container failure.

The present invention has been described in terms of preferred and exemplary embodiments thereof. Numerous other embodiments, modifications and variations within the scope and spirit of the appended claims will occur to persons of ordinary skill in the art from a review of this disclosure.

I claim:

1. In a collapsible box assembly adapted to be manually convertible from a substantially flat box precursor to an erected box, said box assembly comprising (1) a wall structure including a plurality of wall panels of sheet material pivotally connected along adjacent longitudinal edges to form a closed loop, said wall panels comprising pairs of wall panels laid-up against each other in said box precursor and separable from each other to form a polygonal tubular structure in said erected box, by exertion of opposing forces on opposing ones of said longitudinal edges; and (2) a floor structure attached to said wall structure, said floor structure comprising a plurality of floor panels of sheet material, said floor panels comprising pairs of floor panels laid-up against each other, in generally coplanar relation to said wall panels, in said box precursor, said pairs of floor panels being configured such that separation of said wall panel pairs to form said polygonal tubular structure causes a separation of said floor panel pairs and movement of said floor panels at least partially into a box floor forming condition, said floor panels, when placed fully in said box forming condition, partially overlapping with each other in a multi-layer configuration to substantially completely cover an end of said polygonal tubular structure, the improvement wherein:

said wall structure is formed from a first blank of sheet material forming no part of said floor structure, said floor structure comprising a second blank of sheet material distinct from said first blank;

said floor structure comprises a pair of main floor panels hinged to each other about a longitudinal fold line; and each main floor panel is flanked by a pair of flanking floor panels hingedly connected thereto through respective first connecting web panels.

2. The improvement according to claim 1, wherein said first blank of sheet material comprises corrugated fiberboard of a first weight, and said second blank comprises corrugated fiberboard of a second weight lesser than said first weight.

3. The improvement according to claim 1, wherein said floor structure is formed entirely from said second blank of sheet material.

4. The improvement according to claim 1, wherein said floor structure comprises a plurality of flaps attaching the floor structure to the wall structure about substantially an entire perimeter of said closed loop.

5. The improvement according to claim 1, wherein said floor structure comprises a plurality of flaps attaching the floor structure to a plurality of lower exterior surfaces of said wall panels.

6. The improvement according to claim 1, wherein said wall structure forms an octagonal tubular structure in said erected box.

7. The improvement according to claim 1, said wall structure forming in said erected box a polygonal tubular shape which is symmetrical about a central and longitudinal axis thereof.

8. The improvement according to claim 1, wherein each flanking floor panel is an inner flanking floor panel hingedly connected to an outer flanking floor panel through a respective second connecting web panel.

9. The improvement according to claim 8, wherein the first connecting web panels are larger than said second connecting web panels.

10. The improvement according to claim 8, wherein first cut-outs are formed between said main floor panels and said inner flanking floor panels, adjacent to said connecting web panels.

11. The improvement according to claim 8, wherein said main floor panels partially overlap in said floor forming condition with respective ones of said inner and outer flanking floor panels.

12. The improvement according to claim 10, wherein second cut-outs are formed between said inner flanking floor panels and said outer flanking floor panels, adjacent said second connecting web panels.

* * * * *